United States Patent [19]

Hedrick

[11] Patent Number: 4,808,977

[45] Date of Patent: Feb. 28, 1989

[54] ELECTROMECHANICAL EVACUATION EXIT INDICATING FLAG

[76] Inventor: Terry J. Hedrick, P.O. Box 326, Crandall, Tex. 75114

[21] Appl. No.: 87,401

[22] Filed: Aug. 20, 1987

[51] Int. Cl.[4] ..... G08B 17/10; G08B 5/24

[52] U.S. Cl. ..... 340/691; 340/628; 340/629; 340/630; 340/693

[58] Field of Search ..... 340/691, 693, 628, 629, 340/630; 116/5, 204

[56] References Cited

U.S. PATENT DOCUMENTS 2,429,363 10/1947 McLaren .
3,353,170 11/1967 Meili et al. .
3,521,263 7/1970 Lampart et al. .
3,987,426 10/1976 Jansen .
4,074,225 2/1978 Vandeweghe .
4,255,746 3/1981 Johnson et al. .
4,283,657 8/1981 Gordon et al. .
4,422,069 12/1983 Edstrom et al. .
4,489,308 12/1984 Logan, Jr. et al. ..... 340/691

OTHER PUBLICATIONS

The Dallas Morning News, Feb. 13, 1987.
Seton Name Plate Corporation, Product Description.

*Primary Examiner*—Glen R. Swann, III
*Attorney, Agent, or Firm*—Crutsinger & Booth

[57] ABSTRACT

An apparatus for indicating an emergency exit in case of fire in a building, includes a smoke alarm apparatus adapted to relay an electrical activating signal causing a luminous exit indicating flag to be projected outwardly from a wall adjacent an emergency exit and near the floor, for indicating exit locations to persons evacuating a smoke filled building.

20 Claims, 3 Drawing Sheets

ELECTROMECHANICAL EVACUATION EXIT INDICATING FLAG

TECHNICAL FIELD

The present invention relates generally to emergency exits in buildings and more particularly concerns an apparatus for guiding evacuees to emergency exits in case of fire in the building.

BACKGROUND OF THE INVENTION

In the event of fire, smoke and heat initially rise to fill the uppermost atmosphere near the ceiling of a room or hallway. The atmosphere nearer the floor fills with smoke more slowly and affords evacuees breathable air for a longer period of time. Accordingly, when evacuating a burning building, persons are advised to do so by crawling. Conventional exit signs are normally located near the ceiling above emergency exits. So situated, the visibility of these signs is prone to being obscured by smoke, making exits difficult for evacuees to find.

Previous attempts to devise better evacuation exit indicators have typically relied upon high intensity light sources to enhance the visibility of evacuation exit identifiers. U.S. Pat. No. 4,074,225 disclosed an evacuation exit indicator device conventionally mounted near the ceiling above an emergency exit and incorporating a spot lamp emitting yellow colored light flashes which is described as being, even under some smoke conditions, at least partially visible to the floor occupants. U.S. Pat. No. 4,283,657 discloses a similar device incorporating continuously recharged auxiliary batteries to guarantee operation in the event of electrical power failure. U.S. Pat. No. 4,422,069 discloses flashable lights situated adjacent an exit door and near the floor. The flashable light sources are powered by auxiliary rechargeable batteries in the event of an electrical system failure.

Devices mounted near the ceiling may be rendered invisible by thick acrid smoke from burning plastic and other synthetic building materials. Electrical high intensity light sources may be rendered inoperable by water sprayed from overhead water sprinkler systems. Floor level flashable lights are subject to damage from normal traffic, delivery dollies and routine building maintenance such as vacuuming. Prior art devices are also costly to manufacture and install.

The object of the present invention is to provide a reliable evacuation exit indicator device which remains visible to evacuees in the event of a fire.

SUMMARY OF THE INVENTION

An evacuation exit indicator is provided which automatically projects exit indicator flags from walls adjacent an emergency exit in response to detection of threshold accumulations of smoke indicating fire in a building. The evacuation exit indicators of the present invention are characterized by their adaptability to a wide variety of existing alarm devices, their minimal intrusion into traffic areas during non-emergency operation, and their outward projection of exit indicator flags during emergency evacuation; the exit flags being positioned to correspond with the eye level of evacuees escaping the premises by crawling beneath smoke and heat.

According to a preferred embodiment of the invention, an evacuation exit indicator is provided having exit indicator flags incorporating a rechargeable chemical light source for eliminating reliance on electrical power systems or auxiliary batteries to provide visibility.

Other objects and improvements of the invention will be explained in more detail below.

DESCRIPTION OF DRAWINGS

Drawings of a preferred embodiment of the invention are annexed hereto so that the invention may be better and more fully understood, in which.

Numeral references are employed to designate like parts throughout the various figures of the drawing.

DETAILED DESCRIPTION OF THE INVENTION

Figure 1:
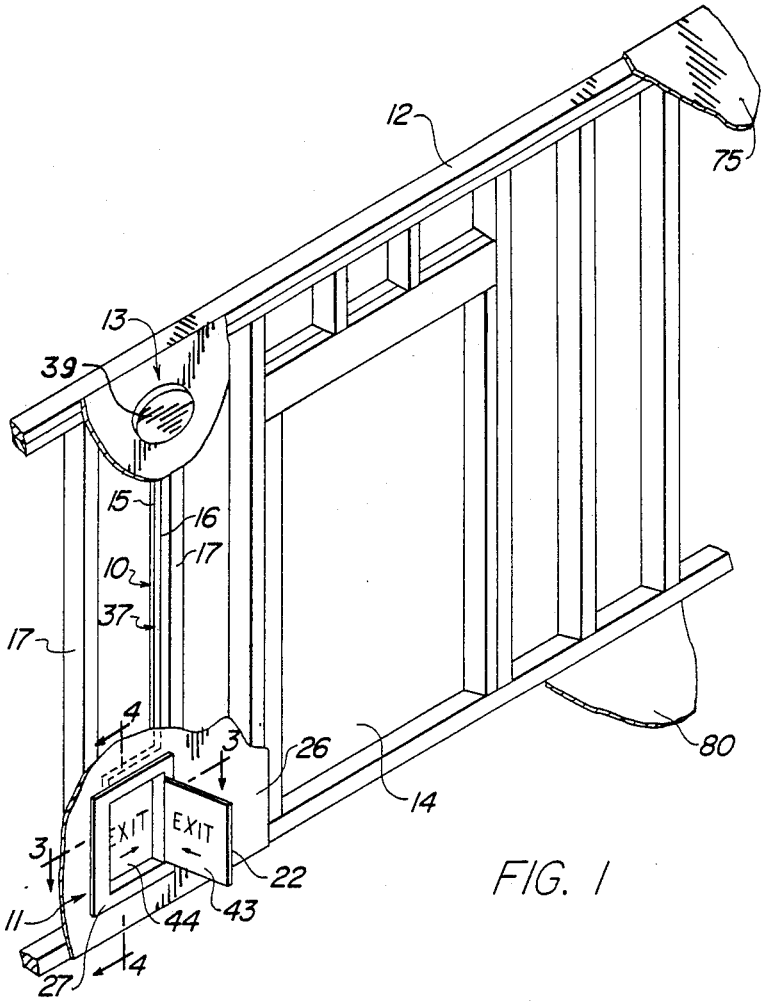
FIG. 1 is a perspective view of the exit indicator installed near an exit, parts being broken away to more clearly indicate details of construction.

Referring now to the drawings, FIG. 1 depicts the evacuation exit indicator of the present invention which for purposes of description is generally identified as reference numeral 10. In FIG. 1, the evacuation exit indicator 10 is depicted in the triggered condition as it would appear to evacuees during a fire. According to a preferred embodiment, the evacuation exit indicator 10 comprises a conventional smoke alarm 13, for example of the type disclosed in U.S. Pat. No. 3,521,263 and commercially available as "Norelco Model HB 0933 Residential Smoke Detector" from North American Philips Corporation. Smoke alarm 13 has been modified to deliver an electrical activating signal to an indicating unit generally designated as numeral 11. Indicating unit 11 is preferably mounted within structure wall 12, adjacent emergency exit door 14, spanning the distance between vertical studs 17 within structure wall 12. Smoke alarm 13 and indicating unit 11 are connected by a pair of electrical wires 15 and 16.

Figure 2:
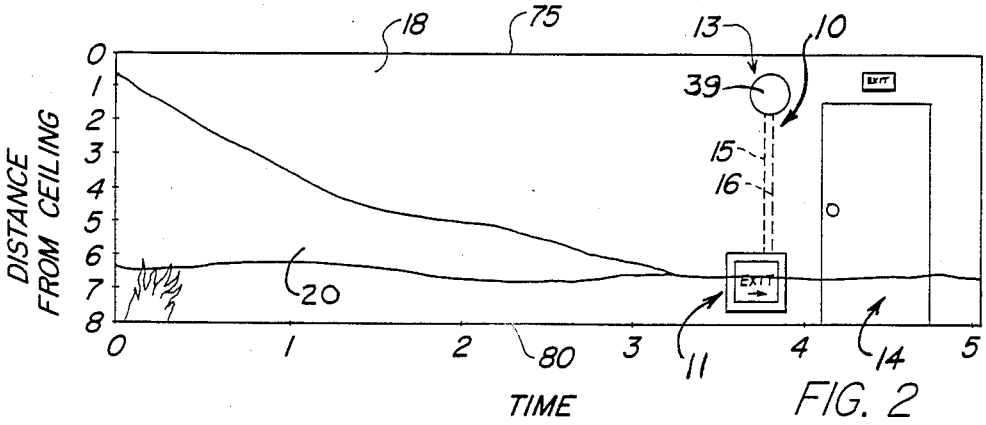
FIG. 2 is a time sequence graph illustrating the temporal order in which portions of a hallway atmosphere fill with smoke during a fire.

FIG. 2 is a diagrammatic time sequence graph generally illustrating how a smoke layer 18 progressively develops near the ceiling 75 of a structure above a layer 20 of hot air. The rate at which the layer 18 of smoke develops extending downwardly from the ceiling 75 is dependent upon the nature of the fire, combustible materials consumed or melted by the fire and available oxygen available from various sources of ventilation. However, as diagrammatically illustrated in FIG. 2, the smoke layer 18 progressively moves downwardly toward the floor 80. Ceilings 75 in typical buildings are approximately eight feet above the floor 80.

Referring to FIG. 2, since smoke 18 and heat 20 initially rise to fill the uppermost atmosphere of a given area, the smoke alarm 13 is preferably mounted near the ceiling for permitting detection of initial accumulations of smoke. The indicating unit is preferably installed approximately ten to eighteen inches above floor level, said height approximating the eye level of evacuees crawling along floor 80 beneath smoke 18 and heat 20 in route to an exit 14.

Figure 3:
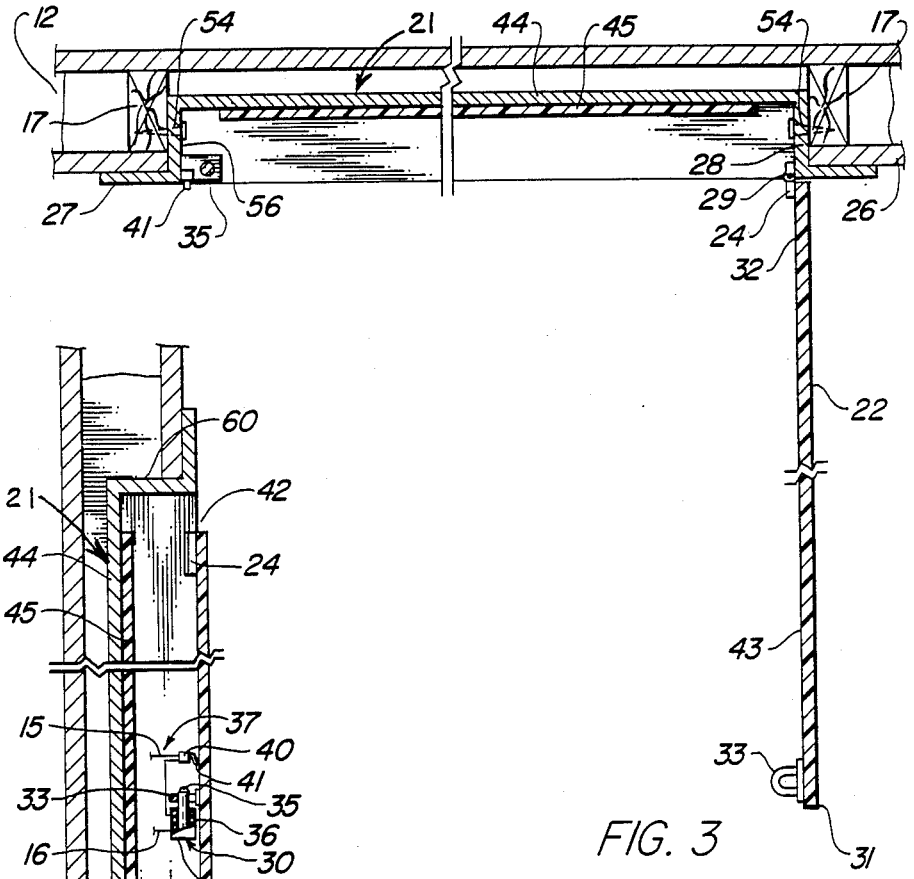
FIG. 3 is a cross-sectional view taken along line 3—3 of FIG. 1, illustrating the device in the triggered condition.
Figure 4:
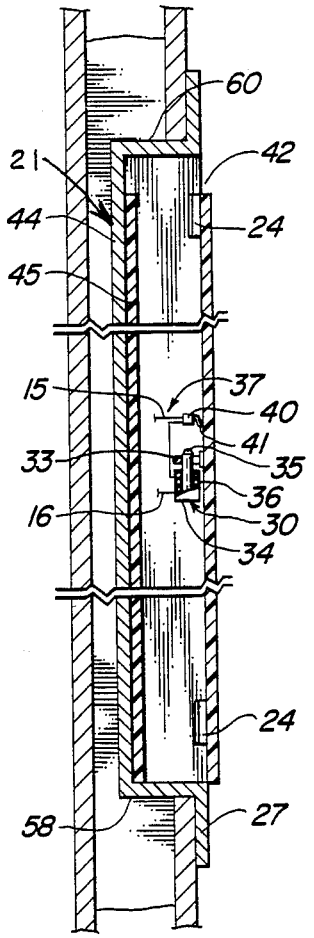
FIG. 4 is a cross-sectional view taken along line 4—4 of FIG. 1 illustrating the exit indicator in a concealed or standby condition.

Turning to FIGS. 3 and 4, indicating unit 11 further comprises an exit indicator flag 22; an electrically activated solenoid operated latch assembly 30; and at least one hinge 24, said hinge 24 being provided with a spring 29 for resiliently urging exit indicator flag 22 to swing outwardly from structure wall 12 on hinge 24 to extend perpendicularly from structure wall 12 in the triggered position depicted in FIGS. 1 and 3.

According to a preferred embodiment, indicating unit 11 is contained within a housing 21 having a boxlike configuration comprising a top 60, a bottom 58, a rear wall 44, a left side wall 56, a right side wall 28, and face plate 27 for permitting indicating unit 11 to be simply installed within structure wall 12 by cutting a hole in sheetrock 26 between two vertical studs 17 and positioning indicating unit therein, abutting face plate 27 against sheetrock 26. Accordingly, when installed, indicating unit 11 is substantially recessed within structure wall 12 for sheltering indicating unit 11 and for minimizing physical intrusion into traffic areas. A plurality of mounting holes are provided in left side wall 56 and right side wall 28 for permitting housing 21 to be secured to vertical studs 17 by nails or the like.

As best shown in FIG. 3, exit indicator flag 22 is attached at its base end 32 to the inside surface of right side wall 28 of housing 21 by hinge 24. The free end 31 of exit indicator flag 22 is provided with a loop 33 for engaging electrically activated latch assembly 30, for permitting exit indicator flag 22 to be secured in the standby position depicted in FIG. 4.

Figure 5:
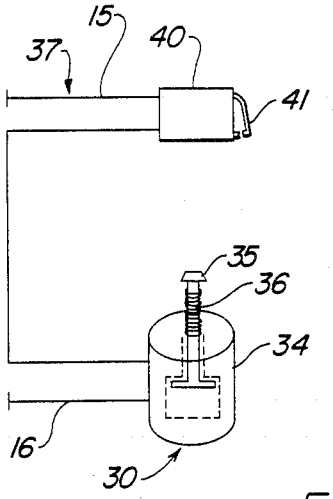
FIG. 5 is an enlarged view illustrating the electrically activated latch assembly and normally open microswitch incorporated the present invention.

As best shown in FIG. 5, electrically activated solenoid actuated latch assembly 30 comprises a magnet coil 34, latch pin 35 and latch spring 36. Electrically activated latch assembly 30 is attached to inside surface of left side wall 56 of housing 21 adjacent free end 31 of exit indicator flag 22. Latch pin 35 is slidably positioned within the central cavity of magnet coil 34. Latch spring 36 resiliently urges latch pin 35 upwardly such that in the normal condition, latch pin 35 protrudes upwardly from magnet coil 34 engaging loop 33 for securing exit indicator flag 22 in the standby position depicted in FIG. 4. In response to current directed through electrical activating signal circuit 37, magnet coil 34 energizes creating a magnetic field for retracting latch pin 35 from its normally latched position and releasing exit indicator flag 22 to pivot outwardly to its triggered position depicted in FIGS. 1 and 3. Coil 34 of the solenoid actuating latch assembly 30 is preferably formed to retract latch pin 35 from loop 33 if an electrical potential in a range between 9 volts and 3 volts is applied to circuit 37. Conventional smoke and heat detectors of the type designated by the numeral 13 momentarily activate an audible alarm 39 (see FIG. 6) when the charge on a 9 volt battery drops to 3 volts. As will be hereinafter more fully explained, when the audible alarm 39 is energized to indicate that the charge on the battery has decreased to a level that requires that a new battery is required, pin 35 will be retracted.

Figure 6:
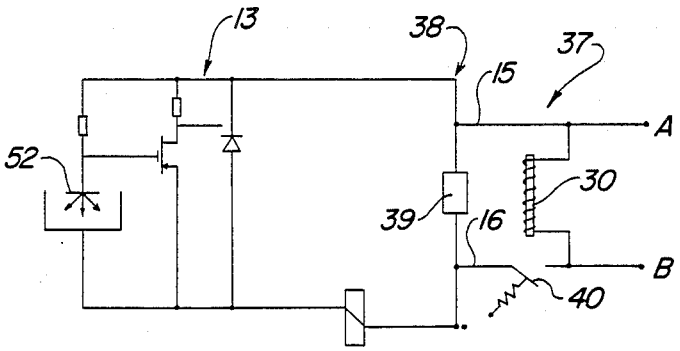
FIG. 6 a wiring diagram illustrating the electronic activating signal circuit.

As shown in FIGS. 5 and 6, electrical activating signal circuit 37 is tied across audible alarm circuit 38 of smoke alarm 13 for simultaneously relaying current to electrically activated latch assembly 30. According to a preferred embodiment of the present invention, electrical activating signal circuit 37 directs current via electrical wires 15 and 16, through a normally open microswitch 40 having a spring bar 41 prior to relaying current to electrically activated latch assembly 30. Depression of spring bar 41 closes the normally open microswitch 40 for permitting current to flow to electrically activated latch assembly 30. The normally open microswitch 40 is attached to inside surface of the left side wall 56 of housing 21 adjacent the free end 31 of exit indicator flag 22 and is situated for permitting spring bar 41 to be held in the depressed condition (consequently closing normally open microswitch 40), by exit indicator flag 22 when indicating unit 11 is in the standby position depicted in FIG. 4.

In the standby position depicted in FIG. 4, exit indicator flag 22 is aligned parallel to structure wall 12, secured to housing 21 by the engagement of latch pin 35 and loop 33 at the free end 31 portion of exit indicator flag 22 and by hinge 24 at the base end of exit indicator flag 22. Spring 29 of hinge 24 is held under tension in the standby position depicted in FIG. 4.

In the event of fire, detection of smoke by the smoke sensing element 52 of smoke alarm 13 energizes audible alarm circuit 38, simultaneously energizing electrical activating signal circuit 37. Current travels through electrical activating signal circuit 37, through normally open microswitch 40, normally open microswitch 40 being held closed due to the depression of spring bar 41 by exit indicator flag 22, for permitting magnet coil 34 to be energized. Thus energized, magnet coil 34 creates a magnetic field sufficient to overcome opposing force of latch spring 36 and retract latch pin 35, for withdrawing latch pin 35 from loop 33. Upon disengagement of the electrically activated latch, spring 29 of hinge 24 forces exit indicator flag 22 to pivot outwardly from housing 21 to a position perpendicularly inclined relative to structure wall 12 as depicted in FIG. 3. Disengagement of electrically activated latch assembly 30 and the resultant repositioning of exit indicator flag 22, releases spring bar 41 reopening normally open microswitch 40 for disconnecting current to electrically activated latch assembly 30 and allowing all available current to be directed via audible alarm circuit 38 to the audible alarm amplifier 39 of smoke alarm 13. Evacuation exit indicator must be manually reset by pushing exit indicator flag 22 to the standby position, reengaging latch pin 35 and engage loop 33.

In accordance with a further aspect of the invention, exit indicator flag 22 comprises at least one sign bearing exit identifying markings on both sides and having a chemical light source for permitting visibility of exit indicator flag 22 in total darkness. Phosphorous signs are commercially available, are reactivated automatically by exposure to light, are unaffected by water from overhead water sprinkler systems, and afford luminance without reliance on electrical systems or auxiliary batteries. Selfilluminating exit signs of the type preferably used to form flag 22 are available from Seton Nameplate Corporaton of New Haven, Conn. and are designated Group 2 Luminous, Catalog No. 770G; 769G; or 768G.

According to another preferred embodiment, an aperture 42 is provided between the top of exit indicator flag 22 and housing 21, spanning the width of exit indicator flag 22, permitting light from hallway fixtures, windows and the like, to enter housing 21 for continuously reactivating the chemical light source incorporated into the inside face 43 of exit indicator flag 22 when exit indicator flag 22 is secured in the standby position. In accordance with the invention, rear wall 44 of housing 21 is provided with a light reflective finish for directing light entering housing 21 through aperture 42 to inside face 43 of exit indicator flag 22.

In keeping with the invention and as depicted in FIG. 1, rear wall 44 of housing 21 may comprise an additional phosphorous sign 45, said sign having a sufficiently light reflective finish to direct light entering housing 21 through aperture 42 to inside face 43 of exit sign 22 for permitting reactivation of the chemical light source therein and for permitting exit identifying markings 23 to be visible from three different directions.

Returning to FIG. 6, in the illustrated embodiment, electrical activating signal circuit 37 is connected to the audible alarm circuit 38 of a conventional smoke alarm 13. It will be readily apparent that current delivered to electrical activating signal circuit 37 may originate from wide variety of alarm circuits, permitting indicating unit 11 to be integrated into existing building alarm systems, for further permitting indicating unit 11 to be triggered in any emergency situation, even in the absence of smoke. Auxiliary circuits to energize the electrically actuated latch assembly 30 may be connected to terminals A and B to deliver current through coil 34 to retract pin 35.

It is an additional feature of the present invention that exit indicator flag 22 will be projected outwardly to the triggered position depicted in FIG. 1 in response to any activation of audible alarm circuit 38 of smoke alarm 13. Since conventional self-contained smoke alarms are powered by batteries which must be periodically replaced, many such smoke alarms are adapted to periodically energize audible alarm circuit 38 momentarily for signaling that the battery is weak and needs to be replaced. Any such activation of audible alarm circuit 38 of smoke alarm 13 will trigger evacuation exit indicator 10, causing exit indicator flag 22 to project outwardly from its standby position and afford a visual indication that the battery operating smoke alarm 13 needs to be replaced.

Thus, it is apparent that there has been provided, in accordance with the invention, an evacuation exit indicator that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An apparatus for indicating an emergency exit in case of fire in a building having a floor, a wall and a ceiling, the exit being formed in the wall, comprising:

an alarm means having an electrically energized signal device, said alarm means being mounted adjacent the ceiling;

an exit indicator flag;

means movably securing said flag to the wall such that said flag is movable relative to the wall between a concealed position and a visible position;

means urging said exit indicator flag toward said visible position;

an electrically activated latch assembly secured to the wall, said latch assembly being adapted to detachably secure said exit indicator flag in said concealed position; and actuating means operably associated with said alarm means and said latch assembly to actuate said latch assembly when said signal device is energized.

2. An apparatus according to claim 1, said exit indicator flag further comprising: at least one luminous chemical light source for providing visibility in the absence of electrical power.

3. An apparatus according to claim 2 wherein said alarm is mounted near the ceiling, and said exit indicator flag is mounted near the floor adjacent an exit, for providing visibility after smoke has filled the upper portions of the area to be protected.

4. An apparatus according to claim 1, with the addition of: means for automatic discontinuation of electrical current to said electrically activated latch assembly when said exit indicator flag is outwardly extended.

5. An apparatus according to claim 1, said actuating means comprising: a circuit to momentarily relay electric current otherwise supplied to said signal device to said actuating means.

6. An apparatus according to claim 5, said actuating means including: a normally open microswitch in said circuit and associated with said latch assembly, said normally open microswitch being adapted to be physically held closed by said exit indicator flag when said exit indicator flag is secured by said latch assembly, said normally open microswitch being adapted to disconnect said current automatically when electrically activated latch assembly disengages in response to an electrical activating signal, releasing said exit indicator flag to the visible position.

7. An apparatus according to claim 1, said exit indicator flag being positioned at a height approximating the eye level of a person crawling along the floor

8. An apparatus according to claim 1, said exit indicator flag being positioned adjacent the floor.

9. An apparatus according to claim 1, said indicator flag being positioned in a range between 10 and 18 inches above the floor.

10. An apparatus according to claim 9, said exit indicator flag further comprising: at least one luminous chemical light source rendering the exit indicator flag visible in the absence of electrical power.

11. An apparatus according to claim 10, said actuating means comprising: a circuit to momentarily relay electrical current otherwise supplied to said signal device through said latch assembly; a normally open switch in said circuit adapted to be physically held closed by said exit indicator flag when said exit indicator flag is secured by said latch assembly, said normally open switch being adapted to open said circuit to said latch assembly when said latch assembly releases said exit indicator flag for movement to the visible position.

12. An apparatus for indicating an emergency exit in case of fire in a building having a floor, a wall and a ceiling, the exit being formed in the wall, comprising:

a smoke alarm means having an electrically energized signal device, said smoke alarm means being mounted adjacent the ceiling;

a chemically illuminated exit indicator visible in the absence of electrical power;

means movably securing said exit indicator to the wall adjacent the floor such that said indicator is movable relative to the wall between a concealed position and a visible position;

means urging said exit indicator toward said visible position;

an electrically activated latch assembly secured relative to the wall, said latch assembly being adapted to detachably secure said exit indicator in said concealed position; and actuating means operably associated with said smoke alarm means and said latch assembly to actuate said latch assembly when said signal device is energized.

13. An apparatus according to claim 12, said exit indicator being positioned at a height approximating the eye level of a person crawling along the floor.

14. An apparatus according to claim 12, said exit indicator being positioned adjacent the exit.

15. An apparatus according to claim 12, said indicator being positioned between 10 and 18 inches above the floor.

16. An apparatus according to claim 12, said latch assembly further comprising: solenoid actuated latch means.

17. An apparatus according to claim 16, said actuating means comprising: a circuit to momentarily relay electrical current otherwise supplied to said signal device through said solenoid actuated latch means; a normally open switch in said circuit adapted to be physically held closed by said exit indicator when said exit indicator is secured by said latch means, said normally open switch being adapted to disconnect current to said solenoid actuated latch means when said latch means releases said exit indicator for movement to the visible position.

18. Apparatus for indicating an emergency exit in case of fire in a building having a floor, a wall and an exit, the exit being formed in the wall, comprising: a smoke detector mounted adjacent the ceiling; a chemically illuminated exit indicator visible in the absence of electrical power; a housing secured relative to the wall adjacent the floor; means pivotally securing said exit indicator in said housing; electrically actuated latch means detachably securing said exit indicator in said housing such that said exit indicator lies in a plane generally parallel to the wall; spring means associated with said housing and said exit indicator urging said exit indicator toward a position in a plane generally perpendicular to said wall; and actuating means associated with said smoke detector and said latch means to cause said exit indicator to move to the position generally perpendicular to the wall when smoke accumulates adjacent the ceiling.

19. Apparatus for indicating an emergency exit in case of fire in a building having a floor, a wall and an exit, the exit being formed in the wall, comprising: a chemically illuminated exit indicator visible in the absence of electrical power; a housing secured relative to the wall; means pivotally securing said exit indicator in said housing; remotely actuated latch means detachably securing said exit indicator in said housing such that said exit indicator lies in a range generally parallel to the wall; means associated with said housing and said exit indicator urging said exit indicator toward an extended position in a plane generally perpendicular to said wall; and actuating means associated with said latch means to cause said exit indicator to move to the extended position.

20. Apparatus for indicating an emergency exit in case of fire in a building having a floor, a wall and an exit, the exit being formed in the wall, comprising:

a sign having markings designating an exit; and means mounting said sign on a wall adjacent the floor such that said sign is readable by an evacuee crawling on the floor below smoke extending downwardly from the ceiling.

* * * * *